US005821477A

United States Patent [19]

Gerstenkorn

[11] Patent Number: 5,821,477

[45] Date of Patent: Oct. 13, 1998

[54] METHOD AND APPARATUS FOR GENERATING ELEVATOR CAR POSITION INFORMATION

[75] Inventor: Bernhard Gerstenkorn, Dierikon, Switzerland

[73] Assignee: Inventio AG, Hergiswil, Switzerland

[21] Appl. No.: 577,731

[22] Filed: Dec. 22, 1995

[30] Foreign Application Priority Data

Jan. 20, 1995 [CH] Switzerland ..... 00 153/95

[51] Int. Cl.[6] ..... B66B 1/34

[52] U.S. Cl. ..... 187/394; 187/316; 187/391

[58] Field of Search ..... 187/394, 393, 187/391, 316, 283

[56] References Cited

U.S. PATENT DOCUMENTS

| | | | |
|---|---|---|---|
| 3,963,098 | 6/1976 | Lewis et al. | 187/29 R |
| 4,427,095 | 1/1984 | Payne et al. | 187/29 R |
| 4,433,756 | 2/1984 | Caputo et al. | 187/29 |
| 4,977,984 | 12/1990 | Arnosti et al. | 187/134 |
| 5,135,081 | 8/1992 | Watt et al. | 187/134 |
| 5,421,432 | 6/1995 | Strambi et al. | 187/288 |
| 5,448,049 | 9/1995 | Shafer et al. | 235/462 |

FOREIGN PATENT DOCUMENTS

| | | |
|---|---|---|
| 1-294180 | 11/1989 | Japan . |
| 6-156910 | 6/1994 | Japan . |

*Primary Examiner*—Robert Nappi
*Attorney, Agent, or Firm*—William J. Clemens

[57] ABSTRACT

A reflector mounted in an elevator shaft and having coded symbols in two tracks in the region of a stopping floor is read by detectors on the car for bridging door contacts when the car is in the arrival region and the resetting region of the stopping floor. The symbols are detected and evaluated by a two-channel evaluating circuit having optical transmitters for illuminating the tracks and charge-coupled device sensors for detecting the reflected images. A pattern recognition logic system and computers for each channel recognize patterns in the images for generating car position and speed information and for actuating relays to bridge the door contacts.

18 Claims, 3 Drawing Sheets

METHOD AND APPARATUS FOR GENERATING ELEVATOR CAR POSITION INFORMATION

BACKGROUND OF THE INVENTION

The present invention relates generally to an apparatus for generating elevator shaft information and, in particular, to an apparatus for sensing elevator car position relative to a stopping floor.

The U.S. Pat. No. 4,433,756 shows an elevator car in an elevator shaft in which a coded tape extends the length of the shaft. The coding is defined by openings arranged in two tracks along the length of the tape. A light transmitter and an opti-electronic receiver are mounted on the elevator car and the coded tape extends between the transmitter and the receiver so that the light beam generated by the transmitter either pass through the openings to the opti-electronic receiver or are interrupted by the tape. Thus, binary coded information related to the position of the elevator car in the shaft is generated as the car moves.

A disadvantage of this known equipment is that inaccurate car position information can result due to the longitudinal expansion of the elevator shaft and thereby of the coded tape.

A further disadvantage is the great effort required for fastening the tape in the elevator shaft. In order that no erroneous information be generated, the tape must be supported precisely over the entire height of the shaft. Beyond that, inaccuracies in the guidance of the elevator car can have a negative effect on the reliability of the shaft information.

Another disadvantage is that the coded tape is supported away from the shaft wall and projects into the shaft space. The shaft cross-section must correspondingly be increased to accommodate the tape and the associated supports.

Yet a further disadvantage concerning safety is that it cannot be distinguished whether a light transmitter or receiver is defective or whether the light beam simply is interrupted by the coded tape. Such a fault case thus cannot be distinguished from the normal function.

SUMMARY OF THE INVENTION

The present invention concerns a method and apparatus for generating elevator car position data and controlling door contacts as the car approaches a stopping place at a floor. The method includes the steps of: a. providing a plurality of coded symbols spaced apart along a path of travel of the elevator car in an elevator shaft; b. reading the symbols in sequence in a direction of movement of the elevator car along the path; c. recognizing a pattern in an image of each of the symbols being read; d. comparing the recognized pattern with a reference pattern; and e. generating shaft position information related to an actual position of the elevator car in the elevator shaft from the recognized pattern. The recognized patterns include at least one bright region having a bright center and at least one dark region having a dark center and the step e. includes computing a pattern repetition displacement from which the actual position of the elevator car is derivable from spacing between the dark centers of the recognized patterns.

After the step d., a step of testing the bright centers and the dark centers for uniformity by ascertaining a percentage of the image of equal brightness value and omitting the step e. for any image having less than a predetermined percentage of equal brightness value is performed. The step e. can be performed by computing the displacement as a displacement of the recognized pattern relative to a last recognized pattern and computing a speed of the elevator car by dividing the displacement by a predetermined scanning cycle time. The method also can include a step of identifying an arrival region and a resetting region at a stopping floor from at least one of the recognized patterns and bridging door contacts as the elevator car moves into the stopping floor. The method further can include a step of comparing a speed of the elevator car with a maximum permitted speed corresponding to at least one of the arrival region and the resetting region before performing the step e.

The apparatus according to the present invention includes a means for displaying a plurality of coded symbols in two side-by-side generally vertically extending tracks adapted to be mounted in an elevator shaft adjacent a path of travel of an elevator car; a means for reading the symbols including at least one detector for each said track adapted to be mounted on the elevator car and for generating an image of each of the symbols in an associated one of the tracks; and a means for evaluating the images connected to the means for reading including a pattern recognition means connected to each the detectors for recognizing a pattern in each image and computing means connected to the pattern recognition means for generating position information representing an actual position of the elevator car in the elevator shaft. The means for displaying can include a generally vertically extending reflector having a generally planar surface wherein the symbols are formed on the surface. Each of the detectors can include an optical transmitter for generating a beam of light on the associated one of the tracks and a sensor for detecting the beam of light upon reflection from the surface.

The apparatus also includes a relay logic system connected to the computing means and a relay connected to the relay logic system, the relay logic system being responsive to a release signal generated by the computing means for actuating the relay and bridging door contacts associated with the elevator car. The means for evaluating includes a first channel, a second channel and a comparator connected to the channels, each of the channels including one of the detectors and the computing means, the computing means in each of the channels including a computer, a data storage device, a program and parameter storage device, an interface and a bus system connecting the pattern recognition logic system, the computer, the data storage device, the program and parameter storage device and the interface together. The comparator includes a position comparator connected to the interface for comparing position signals generated by the computers, a speed comparator connected to the interface for comparing speed signals generated by the computers and an error collector connected to the position comparator and the speed comparator and being responsive to error signals generated by the comparators for generating a fault signal to prevent bridging of door contacts associated with the elevator car.

It is an advantage of the present invention the reliability of the shaft position information is improved.

Another advantage achieved by the present invention is that the safety of the elevator can be increased by the improved reliability of the shaft position information. False shaft information initiated by damaged or defective parts is recognized by the system according to the present invention and does not lead to false results. For example, the bridging of the door contacts is not initiated upon the elevator car moving into a stopping place if the shaft position information necessary for this operation is faulty.

A further advantage of the present invention is that several functions, for example positional monitoring, speed monitoring, door circuit bridging and self—diagnosis, can be fulfilled with the same equipment and shaft position information. Thereby, the requirement for inherent safety is fulfilled.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The car position information apparatus according to the present invention is explained below with reference to an example of an embodiment for the bridging of door contacts in response to information corresponding to the position of an elevator car in an elevator shaft. During the movement of the elevator car into a stopping position at a floor, the floor doors and the car doors are opened prematurely for reasons of time saving. The door contacts, which are connected in the safety circuit of the elevator control, must consequently be bridged by a safety apparatus responsive to information representing the position of the car in the elevator shaft. The same applies for the resetting of the elevator car at the floor, which lowers relative to the floor due to cable expansion, when the doors are open.

Figure 1:
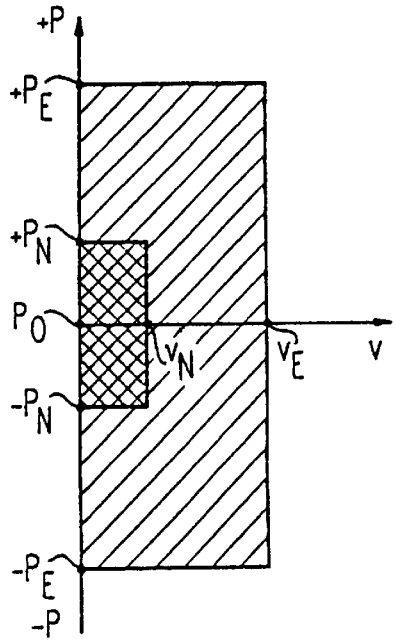
FIG. 1 is a graph of elevator car position as a function of the car speed adjacent a stopping floor.

The regions in which the bridging of the door contacts during stopping and resetting of the elevator car is permitted, and must be monitored by the safety apparatus according to the present invention, are shown in the graph of the FIG. 1. Positions of an elevator car above a stopping place at a floor and positions of the elevator car below the stopping place are illustrated on a vertical axis of the graph in a +P direction and a −P direction respectively. At a position $P_O$ along the vertical axis, the threshold of the elevator car door is flush with the threshold of floor door. The speed of the elevator car is represented on the horizontal axis which is labelled v. The maximum distances above and below the stopping point and the elevator car maximum speed for moving into the stopping floor, for which a bridging of the door contacts is permitted during moving-in to the stopping place, are denoted by $+P_E$, $-P_E$ and $V_E$ respectively. The maximum positions and speed at which a resetting with bridged door contacts is permitted are denoted by $+P_N$, $-P_N$ and $V_N$ respectively.

Figure 2:
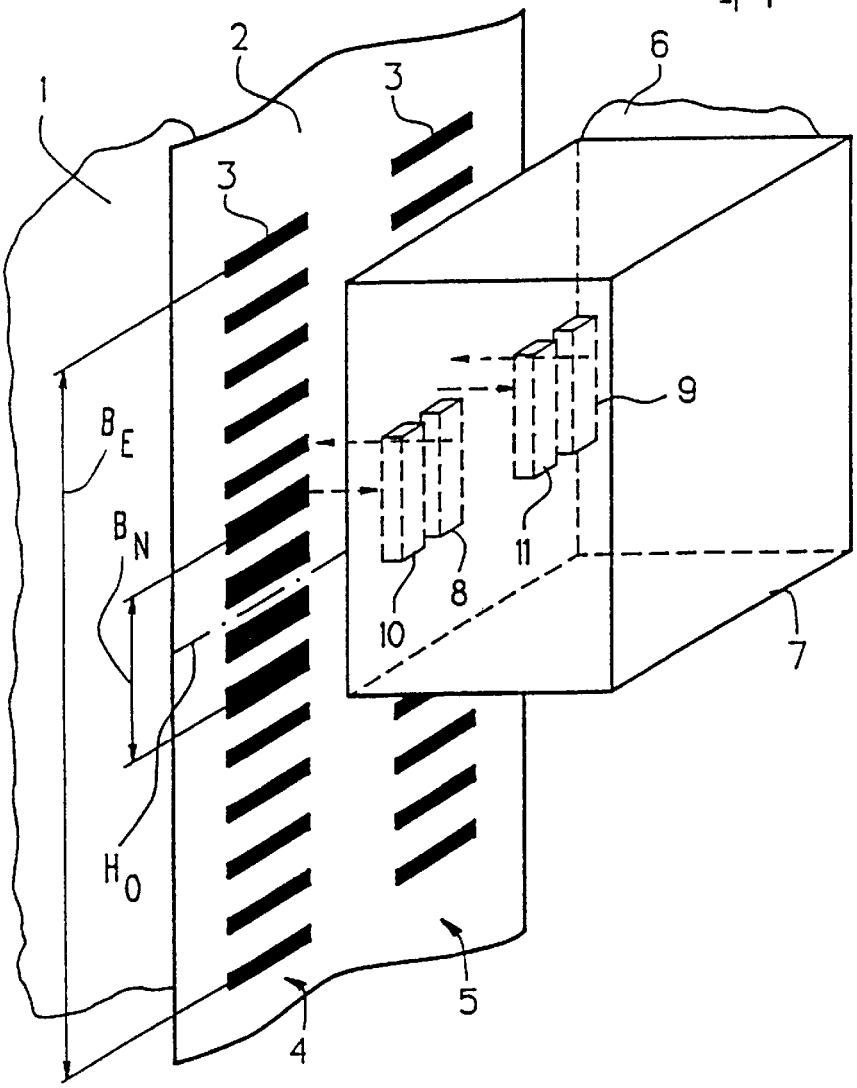
FIG. 2 is a schematic diagram of a sensing portion of an apparatus for generating elevator car position information according to the present invention.

There is shown in the FIG. 2 a portion of an elevator shaft 1 in the area of a stopping place and a portion of a reflector 2 extending generally vertically in the shaft and having a reflecting planar surface on which a plurality of non-reflecting symbols 3 are formed. The symbols 3 are arranged, for example, to represent a two-zone code, a one-dimensional or two-dimensional bar code or a point code. In the example shown, a two-zone code is utilized. The reflector 2 and the symbols 3 form a means for displaying a plurality of coded symbols adapted to be mounted in an elevator shaft adjacent a path of travel of an elevator car. The coded symbols 3 are arranged in a first track 4 and a second track 5, the tracks extending generally vertically along the surface of the reflector 2. Both tracks 4 and 5 are identical in terms of pattern in the present example, but also can be of different patterns. The vertical position of the stopping place for the car 6 is illustrated by a broken line $H_O$ about which the coded symbols 3 are symmetrical. An arrival region $B_E$, in which the bridging of the door contacts is permitted, extends half above and half below the stopping place line $H_O$. A resetting region $B_N$, in which a resetting of the elevator car 6 from a lower position due to cable expansion back to the line $H_O$ is permitted with the doors open and with bridged door contacts, also extends half above and half below the stopping place line $H_O$.

The symbols 3 of the first track 4 and of the second track 5 are detected and evaluated by a two-channel position information circuit 7 mounted in the elevator car 6. The circuit 7 has two identical channels, one for each of the tracks 4 and 5. A means for reading the symbols 3 includes a first optical transmitter 8 of the circuit 7 which illuminates the first track 4 of the reflector 2 and a second optical transmitter 9 which illuminates the second track 5. The illuminated surface of the first track 4 is imaged onto a first charge-coupled device sensor 10 and the illuminated surface of the second track 5 is imaged onto a second charge-coupled device sensor 11 of the circuit 7. The optical components of the transmitters 8 and 9 are matched to the optical components of the charge-coupled device sensors 10 and 11 respectively so that the illuminated surface of the reflector 2 is imaged in focus onto the charge-coupled device sensors in a predetermined area, for example ten to thirty millimeters in length.

Figure 3:
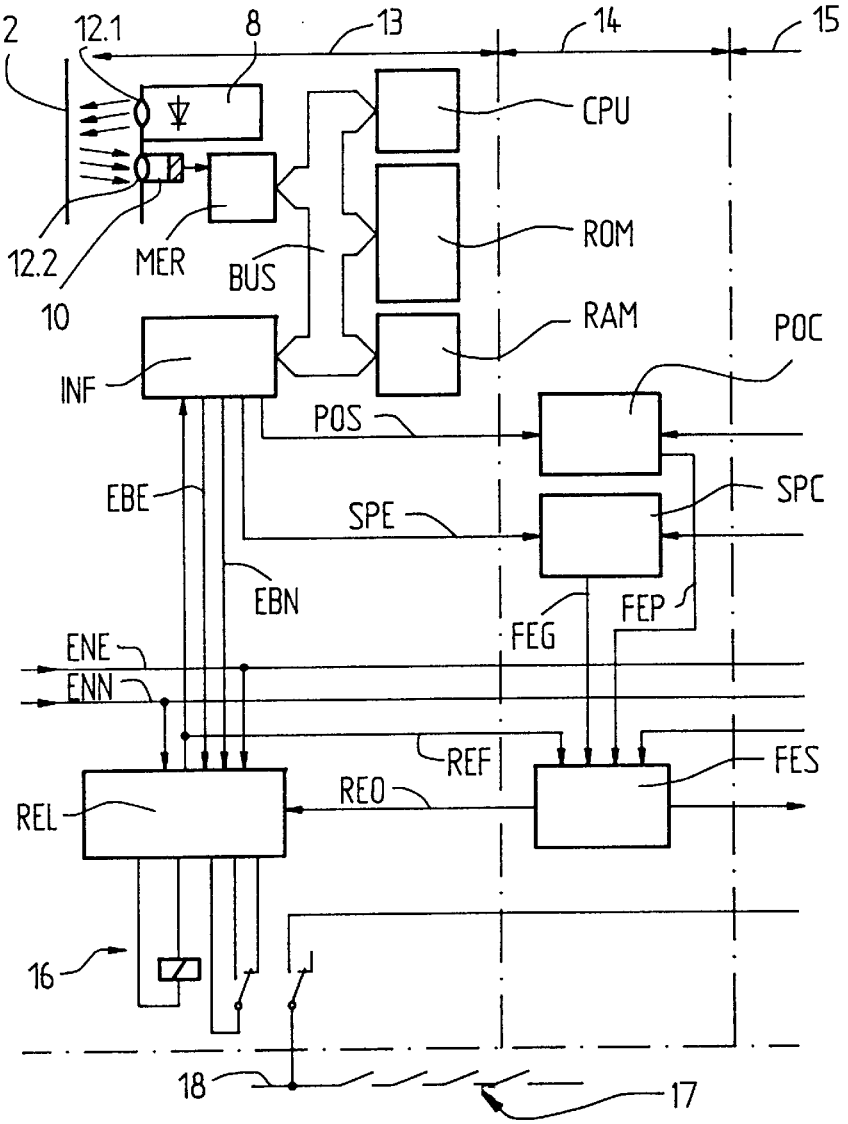
FIG. 3 is a schematic diagram of an apparatus for generating elevator car position information according to the present invention.

There is shown in the FIG. 3 a block schematic diagram of the circuit 7 including a first channel 13 and a comparator 14 shown in detail and a second channel 15, which second channel is identical to the first channel and is therefore not illustrated in detail. The first channel 13 includes the first transmitter 8 with optical components 12.1 and the charge-coupled device sensor 10 with optical components 12.2. The channel 13 also includes a pattern recognition logic system MER having an input connected to an output of the sensor 10 and a port connected to a data bus system BUS. An interface INF and a computer CPU both have a port connected to the bus system BUS. The computer CPU communicates with a program and parameter storage device (read only memory) ROM and with a data storage device (random access memory) RAM which each have a port connected to the bus system BUS. The interface INF also is connected to a relay logic system REL which is connected to a relay 16. In case the conditions for moving-in or for resetting are fulfilled, the relay 16 is actuated to bridge over door contacts 17 of a safety circuit 18 for the elevator car 6. The output signals generated by both the channels 13 and 15 are compared in the comparator 14 and error signals are generated in the case of unpermitted deviations.

A first release signal ENE generated by the elevator control (not shown) permits the opening of the doors on the moving-in of the elevator car 6 and a second release signal ENN, also generated by the elevator control, permits the resetting of the elevator car with the doors open. The release signals are generated on separate lines connected to separate inputs of the relay logic system REL in the first channel 13 and separate inputs of a relay logic system (not shown) in the second channel 15. The release signals ENE and ENN also can be generated by the position information circuit 7, since the information necessary for this function is present. The first release signal ENE is generated upon the car 6 moving into the arrival region $B_E$. The second release signal ENN is generated upon the car 6 moving into the resetting region $B_N$. The release signals ENE and ENN are reset upon the car leaving these regions respectively.

The comparator 14 includes a position comparator POC, a speed comparator SPC and an error collector FES. The position comparator POC has a first input connected to an output of the interface INF in the first channel 13, a second input connected to an output of an interface (not shown) in the second channel 15 and an output connected to an input of the error collector FES. The speed comparator SPC has a first input connected to another output of the interface INF in the first channel 13, a second input connected to an output of an interface (not shown) in the second channel 15 and an output connected to another input of the error collector FES. A position signal POS is generated by the interface INF to the position comparator and a speed signal SPE is generated by the interface INF to the speed comparator SPC and similar signals are generated by the corresponding interface in the second channel 15. A first error signal FEP is generated by the position comparator POC to the error collector FES in the case of unpermitted deviations in the position signals POS and a second error signal FEG is generated by the speed comparator SPC to the error collector in the case of unpermitted deviations in the speed signals SPE. The interface INF generates an entry signal EBE when the entry conditions for the elevator car 6 are fulfilled and generates a resetting signal EBN when the resetting conditions are fulfilled. The signals EBE and EBN are generated at separate outputs of the interface INF which are connected to separate inputs of the relay logic system REL. The bridging of the door contacts takes place only when the first release signal ENE and the entry signal EBE or the second release signal ENE and the resetting signal EBN are present simultaneously at the relay logic system REL. A disturbance in the relay logic system REL generates a third error signal REF at an output connected to an input of the interface INF. In the case of errors being present in the error collector FES, a fourth error signal REO is generated at an output connected to an input of the relay logic system REL which responds by switching off the relay 16.

Figure 4:
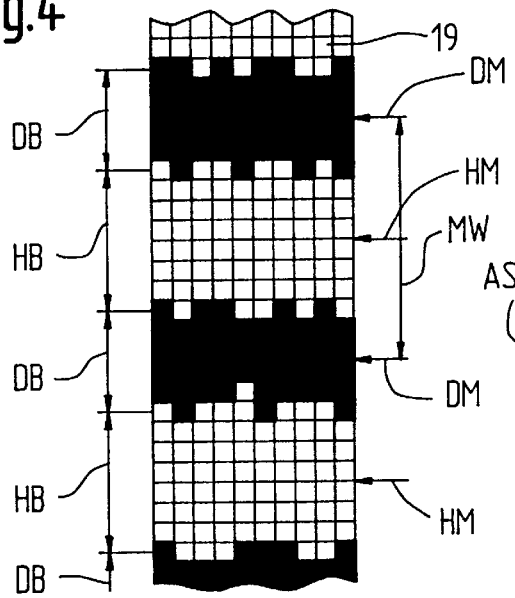
FIG. 4 is a detail of a detected image of the coded symbols shown in the FIG. 2.

The charge-coupled device sensors 10 and 11 include image elements 19, shown in the FIG. 4, which convert the incident light from a field into charges to detect an image of the code 3 on the reflector 2. Such an image includes a predetermined pattern with bright regions HB, dark regions DB, bright centers HM and dark centers DM. There is shown in the FIG. 5 a flow diagram of pattern recognition software used by the pattern recognition logic system MER to cyclicly test the inputs from the sensors 10 and 11. The program sequence is started at an instruction set S0.0 with a first step of switching on a power supply (not shown) of the circuit 7. In a step S0.1, the program enters an initialization instruction set in which the hardware and software initialization is performed. Subsequently, a step S0.2 tests the hardware devices such as the storage devices ROM and RAM, various registers, and so forth. After successful testing, an endless loop comprising the steps S1 to S13 is run through. The endless loop has an approximately constant execution time. "Interrupts" to the loop are not permitted, since equipment relevant to the safe operation of the elevator is concerned.

In the step S1, a check is made of the detected image for the display of unambiguous or recognizable bright regions HB and dark regions DB, and the lengths of the bright regions HB, of the dark regions DB and of a pattern repetition distance MW (shown in the FIG. 4), which is determined by the spacing of the dark centers DM, are ascertained. Also, the bright centers HM and the dark centers DM are tested for uniformity in that the percentage of the image elements 19 with the same brightness values is ascertained. For further processing, the data gathered by the pattern recognition logic system MER is transmitted on the bus system BUS into the data storage device RAM. If an unambiguous pattern has not been recognized, the program branches at "No" to the step S9 discussed below. If an unambiguous pattern has been recognized, the program branches at "Yes" to the step S2.

In step S2, the computer CPU then compares the ascertained pattern stored in the RAM with a reference pattern stored in the program and parameter storage device ROM. If the ascertained pattern does not agree with the reference pattern, the program branches at "No" to the step S9. If there is agreement between the patterns, the program branches at "Yes" to the step S3. For safety reasons, the uniformity of the bright centers HM and the dark centers DM is judged in the step S3. Too low a percentage of the image elements 19 with the same brightness values will not fulfill the entry and resetting conditions. In the case of negative results of the testing, the program branches at "No" to the step S9. Furthermore, a branch at "No" from any of the steps S1 through S3 means that the entry condition or the resetting condition are unfulfilled and the computer CPU signals that result to the interface INF over the bus system BUS. If there is uniformity of the ascertained pattern, the program branches at "Yes" to the step S4.

In the step S4, the ascertained pattern is compared with the last ascertained pattern, previously stored in the data storage device RAM, and the displacement of the ascertained pattern from the last ascertained pattern is computed. The program then enters a step S5 in which the instantaneous speed v of the elevator car 6 is computed by dividing the displacement computed in the step S4 by a scanning cycle time $t_A$. Next, in the step S6, the pattern is tested to determine whether a pattern from the resetting region $B_N$ has been detected. If there is a positive test result, the program branches at "Yes" to the step S7 wherein the instantaneous car speed v is compared with the maximum permitted speed for resetting v, of the elevator car 6. If the car speed is less than the permitted maximum speed for resetting, the program branches at "Yes" to the step S8 in which the positive moving-in and resetting conditions are generated by the computer CPU to the interface INF. In the step S9, the interface INF generates the entry signal EBE and the resetting signal EBN to the relay logic system REL. A negative test result in either of the step S6 or the step S7 causes a branch at "No" to the step S10 in which the instantaneous car speed v is compared with the permitted maximum speed for moving-in $v_e$ of the elevator car 6. If the car speed is too high, the program branches at "No" to the step S9 and the absence of entry conditions is communicated to the interface INF. A positive test result in the step S10 causes a branch at "Yes" to the step S11 in which the positive moving-in condition is generated by the CPU to the interface INF and the program enters the step S9 in which the entry signal EBE is generated to the relay logic system REL. If the entry signal EBE is generated, or the resetting signal EBN and the first release signal ENE are generated, or the second release signal ENN is generated with no error signal REO, the relay 16 is actuated and the door contacts 17 are bridged.

Figure 5:
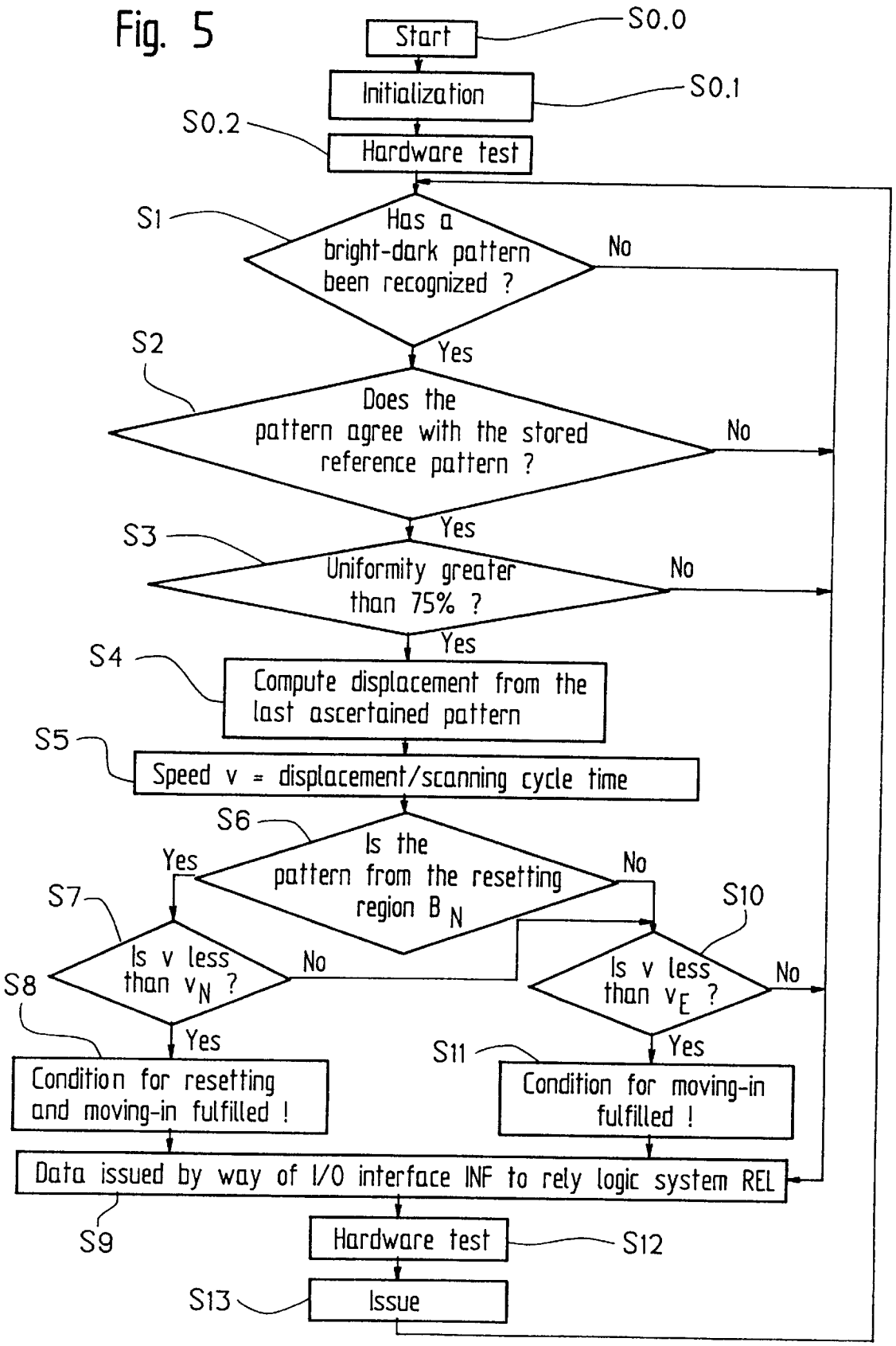
FIG. 5 is a flow diagram of a method for the control of the apparatus shown in the FIG. 3.

The computation of the position of the elevator car 6 is not illustrated in the flow diagram of the FIG. 5. It can be derived on the basis of the first detected pattern and the computed pattern repetition distance MW. The position signal POS derived therefrom serves not only for the comparison with the position signal of the second channel, but also can be used in the elevator control for the fine positioning of the elevator car during moving-in.

Figure 6:
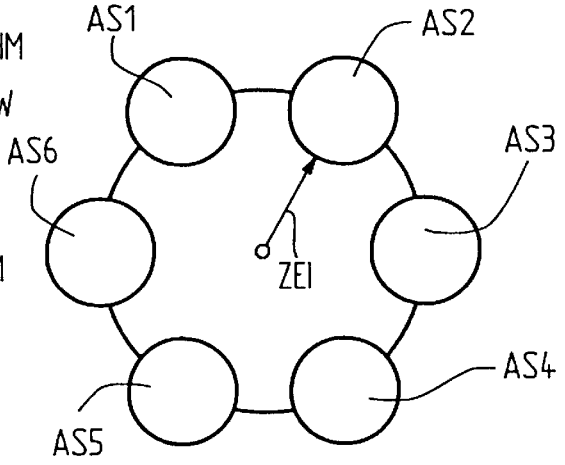
FIG. 6 is a schematic illustration of the dividing-up of the hardware test step shown in the FIG. 5.

A test is performed in the step S12 of the hardware such as the storage devices RAM and ROM, registers and so forth. Such a test requires a relatively long time to complete. In order that the endless loop consisting of the steps S1 through S13 can be run through in a relatively short and constant time, the hardware test is subdivided into test portions of equal time duration. There is shown in the shown in the FIG. 6 an example with six test portions AS1 through AS6. A variable, illustrated as pointer ZEI pointing towards the test portion AS2, incrementally steps through the test portions. While the program is running through the loop, the pointer ZEI is set to the next test portion in the sequence AS1 through AS6 which selected test portion is executed during the step S12. The pointer ZEI is incremented after the step S12 so that the next test portion in sequence is tested during the next run-through of the loop. In the present example, the entire hardware test has been executed once after six loop passages. In the step S13, the data ascertained during the hardware test is generated through the interface INF to the position comparator POC and to the speed comparator SPC.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for generating position information for an elevator car adjacent a stopping floor including the steps of:

a. providing a plurality of symbols spaced apart along a path of travel of an elevator car in an arrival region of an elevator shaft adjacent a stopping floor said symbols forming a coded track of alternating bright regions and dark regions corresponding to a reference pattern;

b. reading said symbols in sequence in a direction of movement of the elevator car along the path in said arrival region by sensing an image of each of said bright regions and each of said dark regions as a plurality of image elements;

c. recognizing an ascertained pattern in said image of each of said symbols being read, said ascertained pattern being related to at least one of a length of said image, a repetition distance between a selected pair of said images and a uniformity of brightness values of said image elements forming said image;

d. comparing said ascertained pattern with said reference pattern; and e. generating shaft position information related to an actual position of the elevator car in said arrival region of the elevator shaft from said ascertained pattern.

2. The method according to claim 1 wherein said ascertained patterns include at least one bright region having a bright center between a pair of dark regions each having a dark center and said step e. includes computing a pattern repetition displacement from which the actual position of the elevator car is derivable from spacing between said dark centers of said ascertained patterns.

3. The method according to claim 2 including after said step d. a step of testing said bright centers and said dark centers for uniformity by ascertaining a percentage of said image of equal brightness value and omitting said step e. for any said image having less than a predetermined percentage of equal brightness value.

4. The method according to claim 2 wherein said step e. is performed by computing said displacement as a displacement of said ascertained pattern relative to a last ascertained pattern and computing a speed of the elevator car by dividing said displacement by a predetermined scanning cycle time.

5. The method according to claim 1 including a step of identifying said arrival region and a resetting region at the stopping floor from at least one of said ascertained patterns and bridging door contacts as the elevator car moves into the stopping floor.

6. The method according to claim 5 including a step of comparing a speed of the elevator car with a maximum permitted speed corresponding to at least one of said arrival region and said resetting region before performing said step e.

7. An apparatus for generating position information for an elevator car adjacent a stopping floor comprising:

means for displaying a plurality of symbols adapted to be mounted in an arrival region of an elevator shaft at a stopping floor adjacent a path of travel of an elevator car, said symbols forming a coded track of alternating bright regions and dark regions corresponding to a reference pattern;

means for reading said symbols including at least one sensor adapted to be mounted on the elevator car and for generating an image of each of said symbols, each of said images being formed of a plurality of image elements of a corresponding one of said bright regions and said dark regions, said image elements extending in an array across said coded track and along said coded track for simultaneously sensing entire ones of said bright regions and said dark regions; and means for evaluating said images connected to said means for reading including a pattern recognition logic system connected to said sensor for recognizing an ascertained pattern in each said image, said ascertained pattern being related to at least one of a length of said image, a repetition distance between a selected pair of said images and a uniformity of brightness values of said image elements forming said image and computing means connected to said pattern recognition logic system for generating position information representing an actual position of the elevator car in said arrival region of the elevator shaft.

8. The apparatus according to claim 7 wherein said means for displaying includes a generally vertically extending reflector having a generally planar surface and said symbols are formed on said surface in at least one generally vertically extending track.

9. The apparatus according to claim 7 wherein said means for reading includes an optical transmitter for generating a beam of light on said means for displaying and a sensor for detecting said beam of light upon reflection from said means for displaying.

10. The apparatus according to claim 7 including a relay logic system connected to said computing means and a relay connected to said relay logic system, said relay logic system being responsive to a release signal generated by said computing means for actuating said relay and bridging door contacts associated with the elevator car.

11. The apparatus according to claim 7 wherein said computing means includes a computer, a data storage device, a program and parameter storage device, an interface and a bus system connecting said pattern recognition logic system, said computer, said data storage device, said program and parameter storage device and said interface together.

12. The apparatus according to claim 7 wherein said computing means generates a signal representing an actual speed of the elevator car in response to said ascertained patterns.

13. An apparatus for generating position information for an elevator car adjacent a stopping floor comprising:

means for displaying a plurality of symbols in two side-by-side generally vertically extending coded tracks adapted to be mounted in an arrival region of an elevator shaft adjacent a stopping floor on a path of travel of an elevator car, said symbols forming said tracks as alternating bright regions and dark regions corresponding to a reference pattern;

means for reading said symbols including at least one detector for each said track adapted to be mounted on the elevator car and for generating an image of each of said symbols in an associated one of said tracks, said images each being formed of a plurality of image elements, said image elements extending in an array across said coded track and along said coded track for simultaneously sensing entire ones of said bright regions and said dark regions; and means for evaluating said images connected to said means for reading including a pattern recognition means connected to each said detectors for recognizing an ascertained pattern in each said image, said ascertained pattern being related to at least one of a length of said image, a repetition distance between a selected pair of said images and a uniformity of brightness values of said image elements forming said image, and computing means connected to said pattern recognition means for generating position information representing an actual position of the elevator car in said arrival region of the elevator shaft.

14. The apparatus according to claim 13 wherein said means for displaying includes a generally vertically extending reflector having a generally planar surface and said symbols are formed on said surface.

15. The apparatus according to claim 14 wherein each said detector includes an optical transmitter for generating a beam of light on said associated one of said tracks and a sensor for detecting said beam of light upon reflection from said surface.

16. The apparatus according to claim 13 including a relay logic system connected to said computing means and a relay connected to said relay logic system, said relay logic system being responsive to a release signal generated by said computing means for actuating said relay and bridging door contacts associated with the elevator car.

17. The apparatus according to claim 13 wherein said means for evaluating includes a first channel, a second channel and a comparator connected to said channels, each of said channels including one of said detectors and said computing means, said computing means in each of said channels including a computer, a data storage device, a program and parameter storage device, an interface and a bus system connecting said pattern recognition logic system, said computer, said data storage device, said program and parameter storage device and said interface together.

18. The apparatus according to claim 17 wherein said comparator includes a position comparator connected to said interface for comparing position signals generated by said computers, a speed comparator connected to said interface for comparing speed signals generated by said computers and an error collector connected to said position comparator and said speed comparator and being responsive to error signals generated by said comparators for generating a fault signal to prevent bridging of door contacts associated with the elevator car.

* * * * *